US005760375A

United States Patent [19]

Hall

[11] Patent Number: 5,760,375

[45] Date of Patent: Jun. 2, 1998

[54] HEATED ROLLERS

[76] Inventor: Timothy G. Hall, 638 Oakland, Mukwanago, Wis. 53149

[21] Appl. No.: 727,320

[22] Filed: Oct. 8, 1996

[51] Int. Cl.[6] ..... G06G 15/20

[52] U.S. Cl. ..... 219/470; 399/334; 432/60; 492/46

[58] Field of Search ..... 219/469–471, 219/216; 399/330–334; 432/60, 228; 492/46

[56] References Cited

U.S. PATENT DOCUMENTS

| | | | |
|---|---|---|---|
| 3,930 | 4/1870 | Holt . | |
| 991,860 | 5/1911 | Lane | 219/216 |
| 992,076 | 5/1911 | Smith . | |
| 1,701,156 | 2/1929 | Heritage . | |
| 2,526,906 | 10/1950 | Schaab et al. | 219/19 |
| 3,230,347 | 1/1966 | Beck | 219/469 |
| 3,399,292 | 8/1968 | Boldrige, Jr. | 219/469 |
| 3,412,229 | 11/1968 | Seagrave, Jr. | 219/10.61 |
| 3,448,233 | 6/1969 | Landis | 219/10.61 |
| 3,524,967 | 8/1970 | Orr | 219/469 |
| 3,543,002 | 11/1970 | Poole | 219/354 |
| 3,546,433 | 12/1970 | Johnson et al. | 219/469 |
| 3,586,830 | 6/1971 | Leitner et al. | 219/501 |
| 3,612,170 | 10/1971 | Juppet et al. | 219/469 |
| 3,720,808 | 3/1973 | Morrissey | 219/469 |
| 3,805,020 | 4/1974 | Bates | 219/469 |
| 3,825,725 | 7/1974 | Leitmer, Jr. et al. | 219/530 |
| 3,965,974 | 6/1976 | Sernetz et al. | 165/89 |
| 4,071,081 | 1/1978 | Chielens et al. | 165/89 |
| 4,097,723 | 6/1978 | Leitner et al. | 219/494 |
| 4,109,135 | 8/1978 | Minden et al. | 219/216 |
| 4,363,163 | 12/1982 | McMaster | 29/127 |
| 4,377,336 | 3/1983 | Parks et al. | 219/216 |
| 4,535,230 | 8/1985 | Brieu | 219/470 |
| 4,560,860 | 12/1985 | Fauser | 219/470 |
| 4,585,325 | 4/1986 | Euler | 355/3 FU |
| 4,611,902 | 9/1986 | Schon | 355/3 FU |
| 4,631,792 | 12/1986 | Wesemann et al. | 29/129 |
| 4,647,744 | 3/1987 | Kitano et al. | 219/10.49 A |
| 4,683,627 | 8/1987 | Reinhold | 29/110 |
| 4,717,338 | 1/1988 | Cellier | 432/60 |
| 4,880,961 | 11/1989 | Duncan | 219/469 |

(List continued on next page.)

FOREIGN PATENT DOCUMENTS

| | | | |
|---|---|---|---|
| 57-74769 | 5/1982 | Japan | 219/469 |
| 2-71287 | 3/1990 | Japan | 219/469 |
| 4-145473 | 5/1992 | Japan . | |
| 4-213480 | 8/1992 | Japan . | |
| 6-130845 | 5/1994 | Japan . | |
| 8-234609 | 9/1996 | Japan . | |

OTHER PUBLICATIONS

Krones "Thermocol—Heat Transfer Container Decorating"–Krones, Inc., Franklin, Wisconsin. Feb., 1996.

American Roller "The Heat Is On" Product Brochure, American Roller Company, Bannockburn, Illinois, Est. Dec., 1995.

Tokuden "The First Heated Roll to Offer Cruise Control" Product Brochure, Tokuden, Inc., Kyoto, Japan, Est. Dec., 1995.

*Primary Examiner*—Teresa J. Walberg
*Assistant Examiner*—J. Pelham
*Attorney, Agent, or Firm*—Jansson, Shupe, Bridge & Munger, Ltd.

[57] ABSTRACT

The disclosure involves a heated roller having a generally-cylindrical outer shell, a primary heating coil between the shell and a roller head at the end of the shell. In the improvement, the head includes an independently-controlled (or controllable) auxiliary heating coil so that the end of the roller may be temperature-controlled independently of the shell. The user may thereby "tailor" the temperature profile of the roller to suit a wide variety of applications. In specific embodiments, the auxiliary coil has the same or differing pitch along its length and/or the cable from which the coil is made has the same or differing wattage output per unit of cable length. A heating roller in combination with a transfer cylinder for a heat transfer decorating system is also disclosed.

17 Claims, 5 Drawing Sheets

U.S. PATENT DOCUMENTS

| | | | |
|---|---|---|---|
| 5,041,718 | 8/1991 | D'hondt et al. | 219/216 |
| 5,169,450 | 12/1992 | Opad et al. | 118/621 |
| 5,178,071 | 1/1993 | Hyllberg | 101/489 |
| 5,208,955 | 5/1993 | Schiel | 429/12 |
| 5,241,159 | 8/1993 | Chatteriee et al. | 219/470 |
| 5,286,950 | 2/1994 | Sakata | 219/469 |
| 5,292,298 | 3/1994 | Scannell | 492/46 |
| 5,393,959 | 2/1995 | Kitano et al. | 219/619 |
| 5,408,070 | 4/1995 | Hyllberg | 219/469 |
| 5,420,395 | 5/1995 | Hyllberg et al. | 219/470 |
| 5,453,599 | 9/1995 | Hall, Jr. | 219/544 |
| 5,575,942 | 11/1996 | Watanabe | 219/469 |

HEATED ROLLERS

FIELD OF THE INVENTION

This invention relates to electric heating and, more particularly, to electric heating using a heated roller.

BACKGROUND OF THE INVENTION

Heated rollers have been in wide use for decades and have become all-but-indispensable in such processes as paper converting, paper coating and the like. Examples of heated rollers using resistance heaters (as opposed to induction coils) are disclosed in U.S. Pat. Nos. 3,805,020 (Bates); 3,399,292 (Boldridge, Jr.) and 4,560,860 (Fauser).

Often, it is preferred that a heated roller used in a process exhibit a substantially uniform temperature "profile." That is, it is preferred that the surface temperature of such roller be substantially uniform along its length. But like all other tools of manufacturing, heated rollers are affected by the laws of physics and heat transfer and, often, the roller surface temperature is higher in the middle of the roller and tails off or "droops" at the roller ends. This is not surprising—there is more surface of the roller exposed at the roller ends where the roller heads are located.

Temperature droop is not the only often-undesirable characteristic of heated rollers of certain known types. In some processes, it is useful to elevate the temperature at one or both of the roller ends over that temperature prevailing at the roller longitudinal mid-section. Existing roller configurations do not lend themselves well to such temperature control requirements.

Yet another requirement sometimes imposed upon heated rollers is that of extreme radial pressure. The roller is used in a process which imposes very high bending forces or radial pressure perpendicular to the roller axis of rotation. Such forces cause the roller to "bow" or bend very slightly and (assuming uniform bending forces along the roller length) the amount of bending deflection is a function of the distance of the point under consideration from the roller-supporting end bearings. Some known rollers are less-than-satisfactory for high-radial-pressure applications.

Yet another aspect of prior art roller application involves the matter of detecting the temperature at a particular part of the roller. The Bates patent noted above discloses a roller equipped with temperature sensors. Such sensors are external to the roller and are disposed along the outer roller surface. Their presence and mounting requirements may impair the way in which the roller may be used in a process.

Another application which uses heat as part of the process is heat-transfer container "decorating" whereby heat and pressure are used to transfer a textual and/or graphic image, often in color, from a fast-moving web to a container such as an aluminum beverage can or a bottle. A leading manufacturer of such machines is Krones Company.

Machines for heat transfer decorating use a carousel-like outer shell which rotates about a vertical axis of rotation. Such shell has a plurality of regularly-spaced channels, e.g., six channels, oriented generally parallel to the axis of rotation. (It is fair to say that the shell somewhat resembles a poker chip rack.) Alternating channels have a transfer roller rotating therein for heat-transferring a graphic image from a web to a container. Those channels having no transfer roller therein receive containers during the decorating process. Prior to the advent of the invention, the channels had individual heater devices associated with them and such devices are subject to breakage or other malfunction.

Improvements in heated rollers which address and overcome some of the problems and shortcomings of the prior art would be an important technical advance.

OBJECTS OF THE INVENTION

It is an object of the invention to provide a heated roller overcoming some of the problems and shortcomings of the prior art.

Another object of the invention is to provide a heated roller, the configuration of which permits a substantially uniform temperature along substantially all of the axial length of the roller outer shell.

Another object of the invention is to provide a heated roller which has high resistance to bending loads.

Still another object of the invention is to provide a heated roller capable of providing a roller temperature at the roller end which is higher than the temperature at the middle of the roller.

Another object of the invention is to provide a heated roller configured so that the temperature of the roller end may be controlled independently of the temperature of the roller center.

Yet another object of the invention is to provide a heated roller which is free of external temperature sensors.

Another object of the invention is to provide a heating roller useful with heat-transfer container decorating. How these and other objects are accomplished will become apparent from the following descriptions and from the drawings.

SUMMARY OF THE INVENTION

Aspects of the invention involve a heated roller having an axis of rotation, a generally-cylindrical outer shell and a heating coil between the shell and the axis of rotation. A disc-like closure head is at the end of the shell.

In the improvement, the head includes an auxiliary heating coil which is spirally wound about a head cylindrical boss or is spirally wound "pancake-like" on an inwardly-facing flat face of the head. Using the auxiliary coil, the end of the roller may be temperature-controlled independently of the shell. The new configuration affords some attractive possibilities for improved control of the process with which the heated roller is used.

In a more specific aspect of the invention where the auxiliary coil is helix wound on a head cylindrical surface, such coil has a turn-to-turn pitch and a span length measured parallel to the roller axis of rotation. The coil is made up of a plurality of turns of heating cable and the pitch of the coil is substantially uniform along its span length.

In another aspect of the invention, the heating cable has a uniform wattage output, e.g., 50 watts or 150 watts, per unit of cable length measured along the cable central axis. In this and the other embodiments disclosed herein, a highly-preferred cable is mineral insulated. (While resistance-wire heating cables including mineral insulated cables are known per se, such cables have typically found use in melting ice in eaves troughs, melting snow from driveways and the like. Insofar as is known, mineral insulated cables have never been used in heated rollers.)

In an alternative arrangement, the cable is not of uniform wattage output along its length. The cable includes a first cable portion having a first wattage output per unit of length of the first cable portion and also has a second cable portion having a second wattage output per unit of length of the second cable portion. The second wattage output differs from the first wattage output and may be higher or lower.

However, where the first cable portion is closer to the outward end of the head, it is preferred that the output per unit length of the first cable portion be higher than that of the second cable portion. To put it in other words, it is preferred that the first cable portion be between the end and the second cable portion. This arrangement is preferred because the rate of heat loss at the outward end of the head is greater than the rate of heat loss inwardly of the end of the head.

Another aspect of the invention involves an auxiliary heating coil having a pitch which varies along the coil span length. And using a variable pitch coil nevertheless permits using a cable with two cable portions having differing wattage outputs per unit length.

In another aspect of the invention, the cylindrical boss of the roller head has a face (typically a flat face) which is generally perpendicular to the roller axis of rotation. A flat spiral groove is in the face and receives the auxiliary heater coil which also defines a flat spiral.

And that is not all. In another aspect of the invention, the new roller has at least one temperature sensor axially oriented in the shell. Using two or more sensors, the passage-like holes formed in the shell to receive such sensors may have differing depths so that the sensors "pick up" the roller temperature at different axial points along the roller.

The new roller may be configured for maximum resistance against bending when used in applications where pressure against the roller shell face is high and where roller "straightness" is important. The new roller is able to meet those demands and includes a rigid core extending along the roller axis of rotation. More specifically, the core extends from the axis of rotation radially outwardly and contacts the shell and the roller main heating coil is in a groove formed in the core.

The extra-rigid roll is essentially solid steel from its axis of rotation outwardly to the outer surface of the shell. Maximum resistance against bending is thereby assured.

New heated roller technology is manifested in yet another way involving a machine for heat-transferring a graphic image from a web to a container. A heating roller is in combination with a specially-configured outer shell around the roller. The roller has an axis of rotation and a generally cylindrical outer wall having a helix-wound heating coil on it. The outer shell (i.e., that component which is intimately associated with the image transfer process) is in heat-transfer relationship with the outer wall of the heating roller.

In a more specific aspect of this combination, the outer shell and the outer wall contact one another, thereby eliminating any air gap that might otherwise impede the transfer of heat radially outwardly. The heating coil is in a groove in the outer wall. The new combination also has a cable connection member generally perpendicular to the axis of rotation. And in a very specific embodiment, the roller has a closure panel generally perpendicular to the axis of rotation and such panel is interposed between the connection member and the roller outer wall.

Other details of the invention are set forth in the following detailed description and in the drawings.

DETAILED DESCRIPTIONS OF PREFERRED EMBODIMENTS

Figure 1:
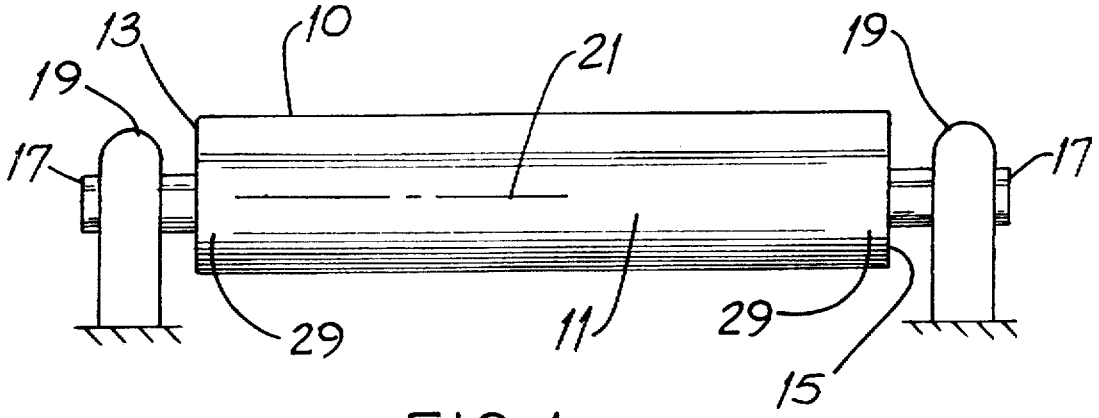
FIG. 1 is an elevation view of the new heated roller supported for rotation on bearing blocks.
Figure 2:
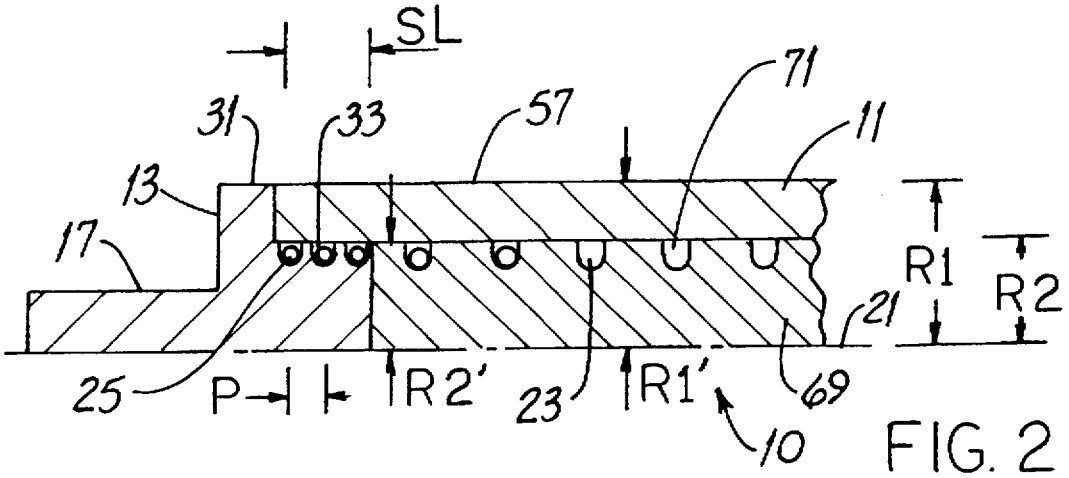
FIG. 2 is a half-section elevation view of one embodiment of the roller of FIG. 1. Parts are broken away.

As shown in FIGS. 1 and 2, an improved heated roller 10 has a hollow, cylindrical outer shell 11 and a pair of disc-like first and second closure heads 13, 15, one at either end of the shell 11. Each head 13, 15 has a roller support shaft 17 protruding therefrom and the shafts 17 are supported by bearing blocks 19 for rotation about an axis of rotation 21.

The roller 10 has a primary heating coil 23 between the shell 11 and the axis of rotation 21. There is also an auxiliary heating coil 25 which is spirally wound about a head cylindrical boss 27. It is to be appreciated that either head 13 or 15 may be configured with a coil 25. But more typically, each of the roller heads 13, 15 has such a coil 25. Using the auxiliary coil(s) 25, the end(s) 29 of the roller 10 may be temperature-controlled independently of the shell 11.

In the following descriptions, aspects of only a single head 13 are described. It is to be understood that depending upon the particular application with which the roller 10 is used, both heads 13, 15 may have an auxiliary heating coil 25 and the configurations of such coils 25 may be the same or may differ as to a particular roller 10 and as to a particular end 29 of a roller 10.

In a more specific aspect of the invention, the head 13 has an annular flange 31, the radius R1 (measured, of course, from the axis of rotation 21) of which is substantially equal to the outside radius R1' of the shell 11. The cylindrical boss 27 protrudes inwardly from the flange 31 and prior to installing the coil-receiving groove 33 and the auxiliary coil 25, the boss 27 has a substantially uniform radius R2 along its length. And such radius R2 is about equal to the inside radius R2' of the roller shell 11. (In practice, the radius R2 may be slightly greater than the radius R2'. To assemble the heads 13, 15 and shell 11, the shell 11 is heated, expands and accepts the boss 27 inserted thereinto).

The auxiliary coil 25 is helix wound on the boss 27 and is seated in a helix groove 33, i.e., a single "axially-long" groove. Such coil 25 has a turn-to-turn pitch P and a span length SL, both measured parallel to the roller axis of rotation 21. The coil 25 is made up of a plurality of turns of heating cable 37 (see FIG. 3) and the pitch P of the coil 25 is substantially uniform along its span length SL. (The term "pitch" as used herein is used in the same sense as the term is used to describe the pitch of screw threads.)

Figure 3:
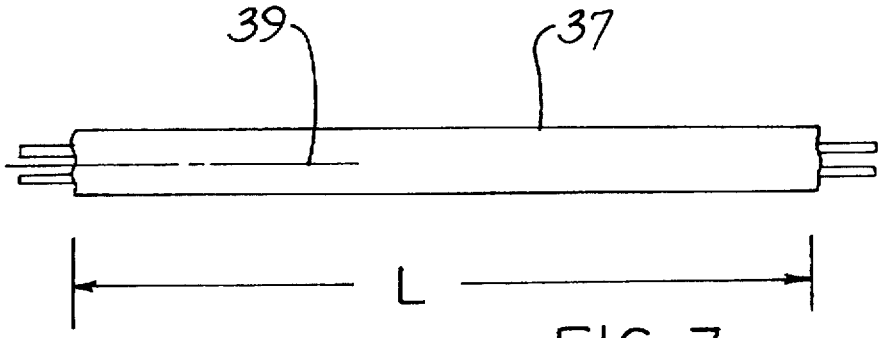
FIG. 3 is a view of a length of heating cable. Parts are broken away.
Figure 4:
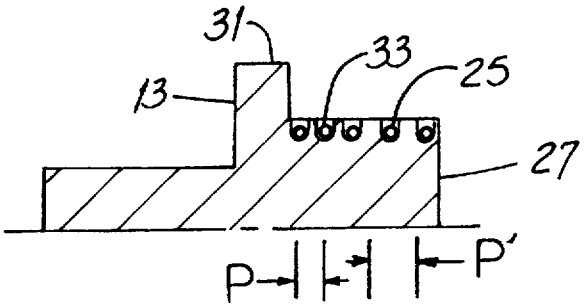
FIG. 4 is a half-section elevation view of a roller head used in another embodiment of the roller of FIG. 1. Parts are broken away.
Figure 5:
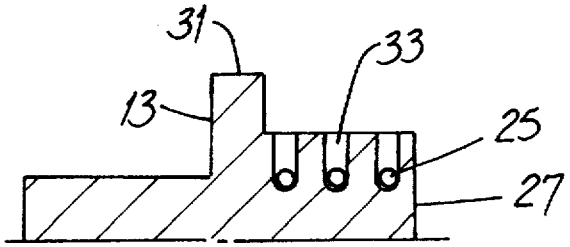
FIG. 5 is a half-section elevation view of a roller head used in yet another embodiment of the roller of FIG. 1. Parts are broken away.

In another aspect of the invention and referring to FIGS. 2–5, the heating cable 37 has a uniform wattage output, e.g., 50 watts or 150 watts, per unit of cable length L measured along the cable central axis 39. In FIG. 2, 4 and 5, a cable 37 having uniform wattage output per unit length L is symbolized by using circles of equal diameter to illustrate the spiral turns of the cable 37.

Figure 6:
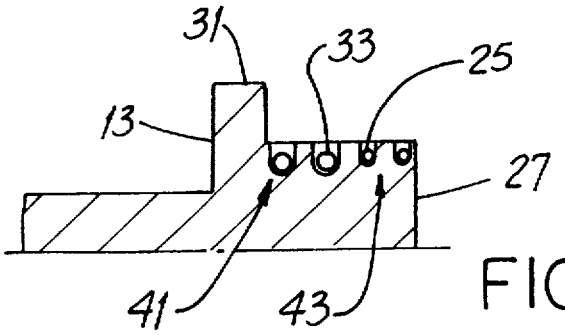
FIG. 6 is a half-section elevation view of a roller head used in still another embodiment of the roller of FIG. 1. Parts are broken away.

In an alternative arrangement shown in FIG. 6, the cable 37 is not of uniform wattage output along its length L. The cable 37 includes a first cable portion 41 having a first wattage output per unit of length L and also has a second cable portion 43 having a second wattage output per unit of length L. The second wattage output differs from the first wattage output and may be higher or lower.

However, where the first cable portion 41 is closer to the flange 31 (and therefore closer to ambient air around the head 13) as shown in FIG. 6, it is preferred that the output per unit length of the first cable portion 41 be higher than that of the second cable portion 43. (In FIG. 6, this is symbolized by using circles of larger diameter to represent the first cable portion 41 and circles of smaller diameter to represent the second cable portion 43.)

To put it in somewhat different terms, it is preferred that the first cable portion 41 be between the end 29 and the second cable portion 43. As noted above, the rate of heat loss at the flange 31 of the head 13 is greater than the rate of heat loss inwardly of such flange 31.

Referring now to FIG. 4, another aspect of the invention involves an auxiliary heating coil 25 having a pitch which varies from P to P' along the coil span length SL. In FIG. 4, the pitch P is less than the pitch P'; that is, the coil 25 is wound more "tightly" adjacent to the flange 31. An advantage of this configuration is higher "heat density" adjacent to the ambient-exposed flange 31 where heat is lost at a more rapid rate. And using a variable pitch coil 25 does not prevent using a cable 37 with two cable portions 41, 43 having differing wattage outputs per unit length.

Figure 7:
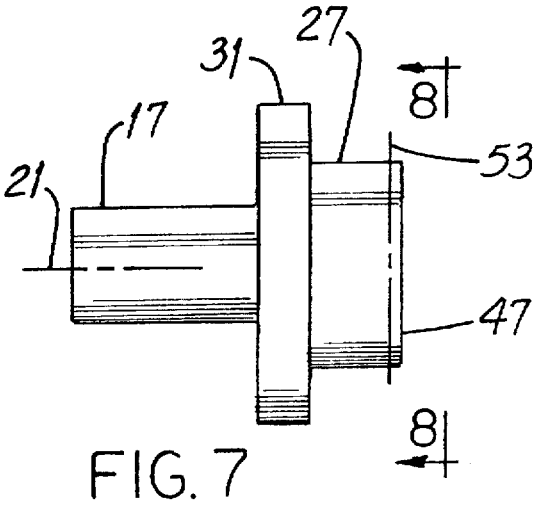
FIG. 7 is an elevation view of a roller head used in yet another embodiment of the roller of FIG. 1.
Figure 8:
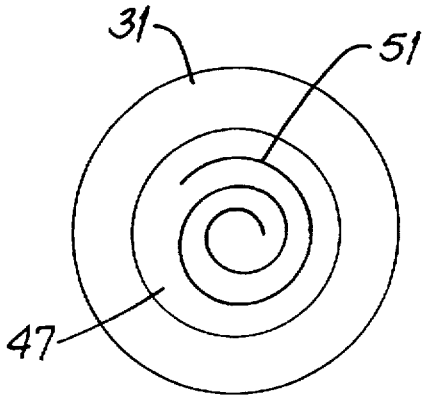
FIG. 8 is an elevation view of the roller head of FIG. 7 taken along the viewing plane 8—8 thereof.

Referring next to FIGS. 7 and 8, another aspect of the invention involves the face 47 of the roller head boss 27. Such face 47 is generally perpendicular to the roller axis of rotation 21. A spiral groove 51, preferably a flat spiral groove 51, is in the face 47 and receives the auxiliary heater coil 25. In this configuration, the auxiliary coil 25 is "pancake-like" (rather than "screw-like") in that in the highly preferred embodiment, all turns of the coil 25 are in the same plane 53.

Figure 9:
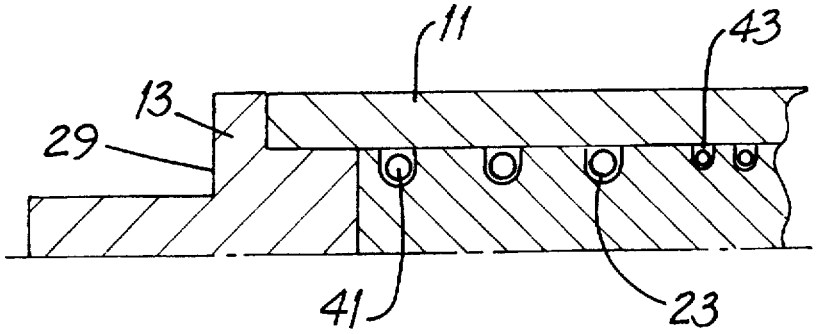
FIG. 9 is a half-section elevation view of the new roller in yet another embodiment. Parts are broken away.

Referring to FIGS. 3 and 9, FIG. 9 shows how the primary heating coil 23 may be configured like the auxiliary coil 25 shown in FIG. 6. That is, the primary coil 23 has a first cable portion 41 having a higher heat output per unit length L than the second cable portion 43. This arrangement compensates for higher heat loss at the left end 29.

Figure 10:
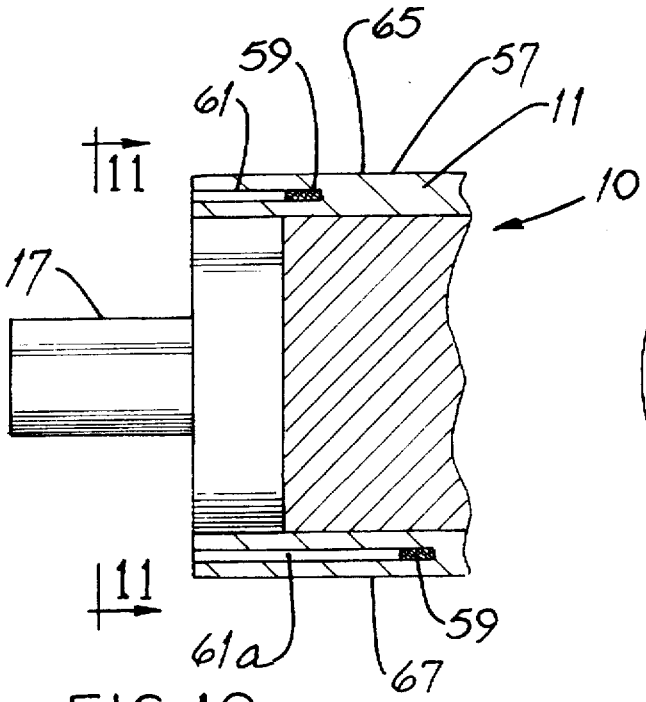
FIG. 10 is a sectional elevation view showing how temperature sensors are mounted in the shell of the roller of FIG. 1. Parts are broken away and other parts are shown in full representation.
Figure 11:
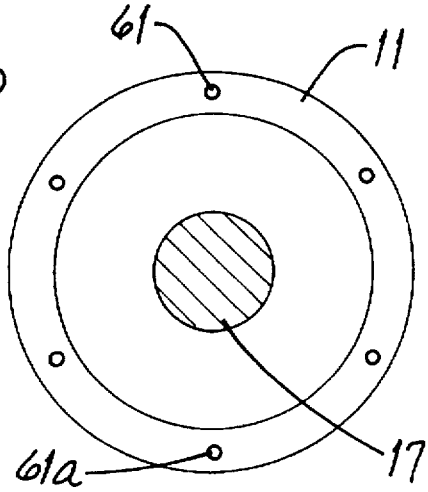
FIG. 11 is a part-section elevation view taken along the viewing plane 11—11 of FIG. 10.

Referring next to FIGS. 10 and 11, it is noted above that temperature control of any part of a roller surface 57 requires some type of temperature sensor. The new roller 10 has at least one temperature sensor 59 axially oriented in the shell 11. One specific configuration uses a plurality of sensors 59, e.g., six sensors 59, which are uniformly radially spaced around the shell 11. In the specific embodiment shown in FIG. 11, the sensors 59 are 60° apart. Referring again to FIG. 10, the passage-like "wells" or holes 61, **61*a* formed in the shell 11 to receive sensors 59 may have differing depths. When the roller 10 is so configured, the sensors 59 "pick up" the roller temperature at different axial points 65, 67 along the roller 10**.

Referring again to FIG. 2, depending upon the application, the new roller 10 may be required to exhibit maximum resistance against bending forces. The new roller 10 is able to meet those demands and includes a rigid core 69 extending along the roller axis of rotation 21. Such core 69 extends from the axis of rotation 21 radially outwardly and contacts the shell 11. The roller primary heating coil 23 is in a groove 71 formed in the core 69.

The extra-rigid roller 10 is essentially solid steel from its axis of rotation 21 outwardly to the outer surface 57 of the shell 11. Maximum resistance against bending is thereby assured.

Figure 13:
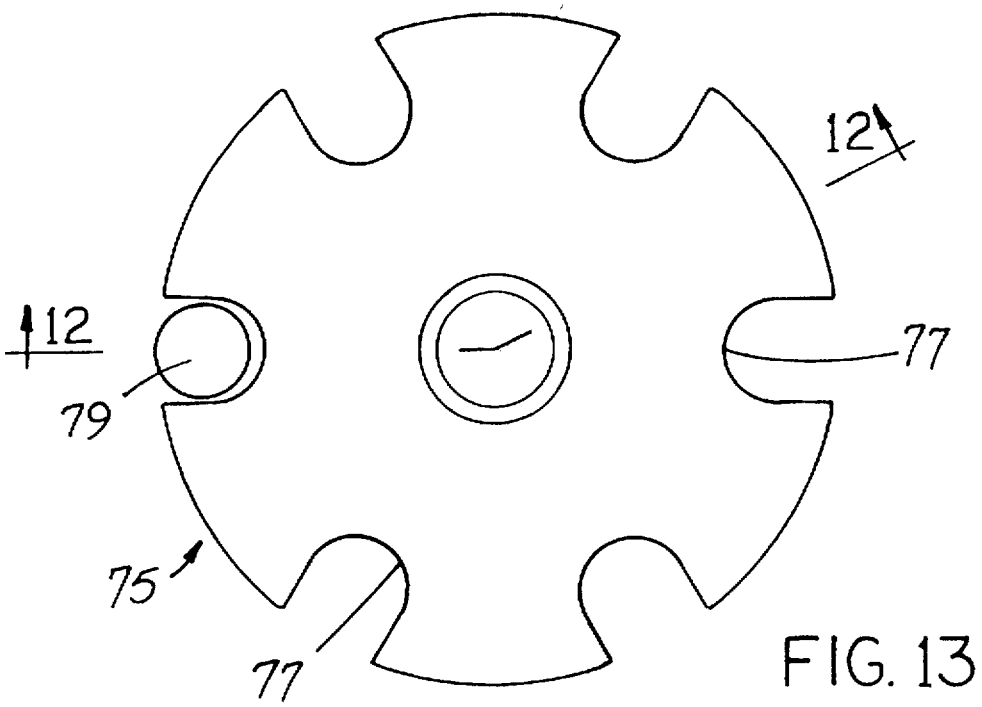
FIG. 13 is a top plan view of the mechanism of FIG. 12 taken along the viewing axis VA13 thereof.
Figure 12:
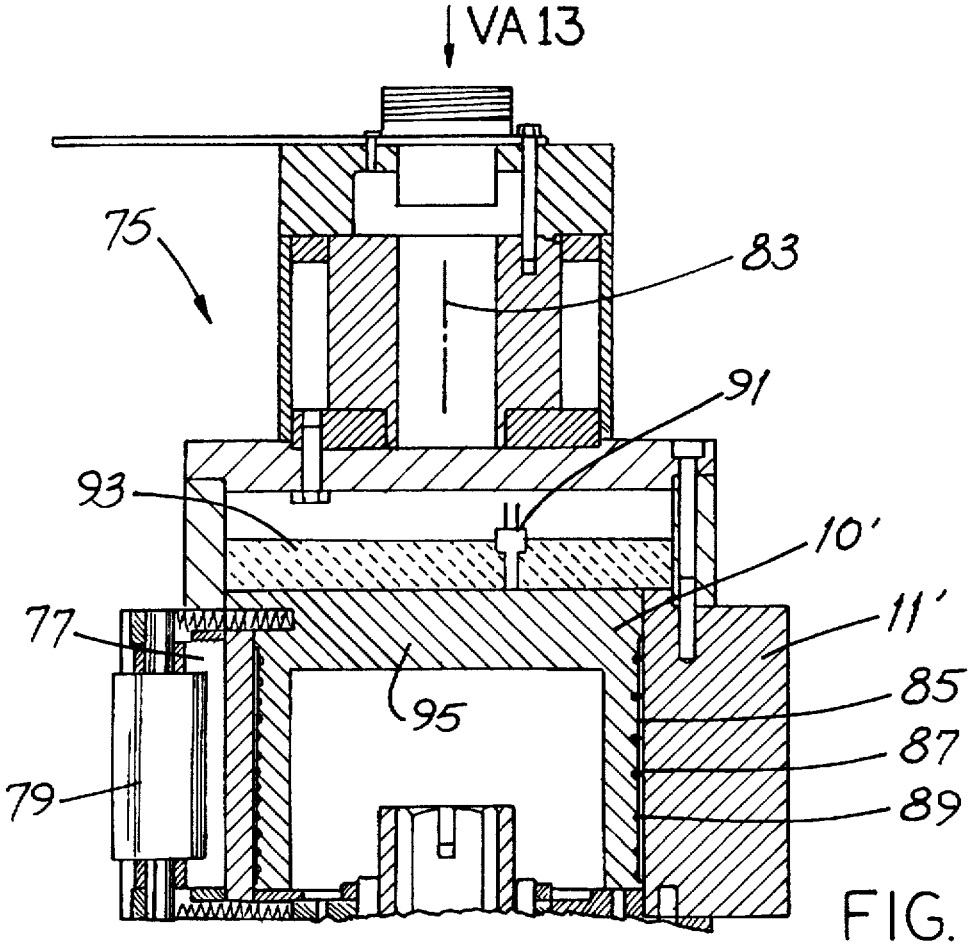
FIG. 12 is a sectional elevation view of a mechanism incorporating a heating roller for heat-transferring a graphic image from a web to a container. The view is along viewing planes 12—12 of FIG. 13 and parts are broken away.

Referring next to FIGS. 12 and 13, new heated roller technology is manifested in yet another way involving a mechanism 75 for heat-transferring a graphic image from a web to a container. The mechanism 75 includes a heating roller 10' in combination with a specially-configured outer shell 11' around the roller 10'. The shell 11' has a number of vertical channels 77 spaced equidistant around its perimeter and a transfer roll 79 freely rotates in each channel 77. In operation, the mechanism 75 revolves about its vertical axis of rotation 83. A thin, moving web having a sequence of images (usually identical images) thereon bears against a roll 79. In turn, a container to which the image is transferred bears against the web. The roll 79 is heated by the heating roller 10' within the shell.

The roller 10' has an axis of rotation 83 and a generally cylindrical outer wall 85 having a screw-like helix-wound heating coil 87 on it. The outer shell 11' (i.e., that component which is intimately associated with the image transfer process) is in heat-transfer relationship with the outer wall 85 of the heating roller 10' and, more specifically, the outer shell 11' and the outer wall 85 contact one another. (The slight space between the wall 85 and the shell 11' shown in FIG. 11 is "artificial" and is included only to make it clear that the wall 85 and shell 11' are two components.) Air space is thereby eliminated and this is desirable since the presence of air, a known insulator, might otherwise impede the transfer of heat radially outwardly. Heat from the shell 11' propagates toward and heats the rolls 79 for image transfer.

The heating coil 87 is in a groove 89 in the outer wall 85 and the new combination also has a cable connection 91. There is also a closure panel 93 generally perpendicular to the axis of rotation 83 and such panel 93 is interposed between the connection member 91 and the roller end wall 95.

Figure 14:
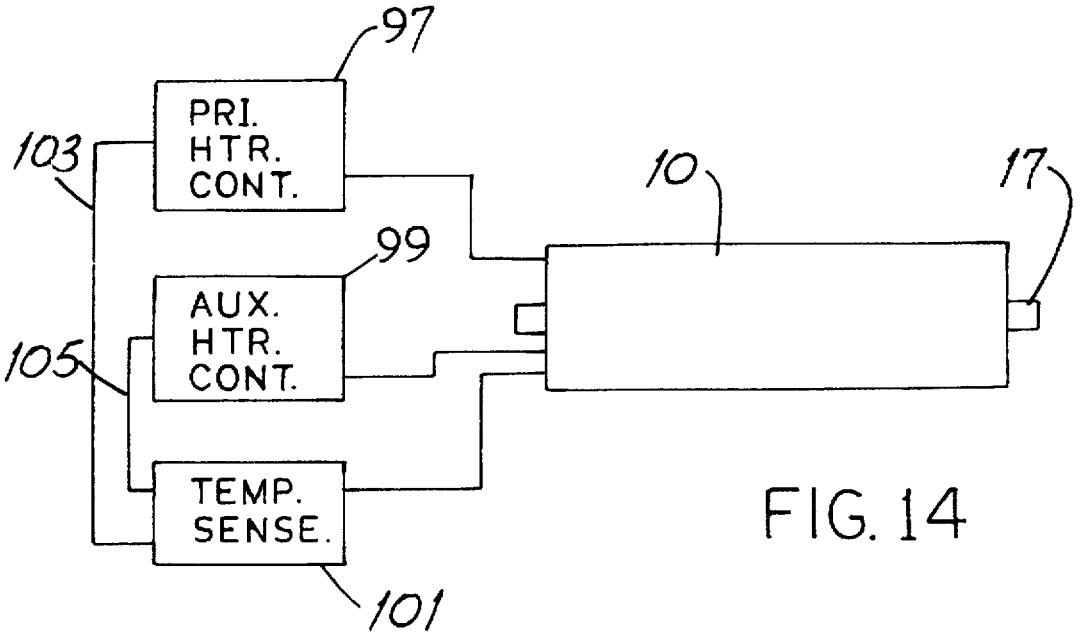
FIG. 14 is a representative view showing the new roller in conjunction with controllers and a temperature sensing unit.

Referring next to FIGS. 2, 9 and 14, the new heated roller 10 may be coupled to a controller 97 which is coupled to and controls the primary heating coil 23. Another controller 99 is coupled to and controls the auxiliary heating coil 25. A temperature sensing unit 101 is coupled to the sensors 61, **61*a* and provides signals to the controllers 97, 99 along the lines 103, 195, respectively. Such signals represent a temperature sensed by a particular sensor 61, 61***a*. (Since the roller 10 rotates with respect to the controllers 97, 99, and the unit 101, electrical connections are through slip rings.)

Figure 16C:
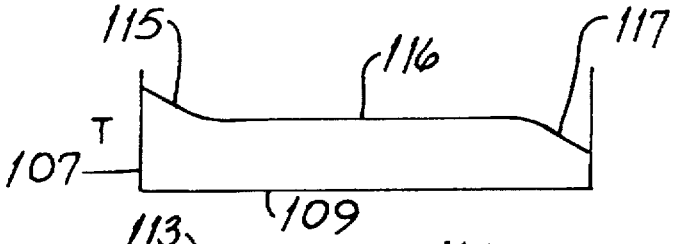
FIGS. 16A, 16B and 16C are positionally-coordinated with FIG. 15 and show several roller surface-temperature characteristics that are available using the new roller.
Figure 16B:
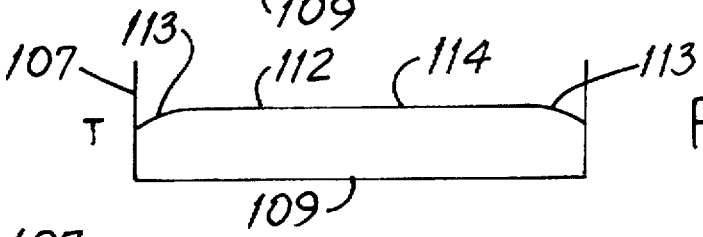
Figure 16A:
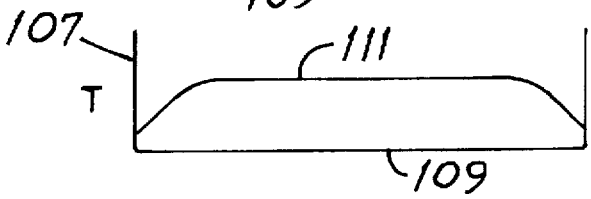
Figure 15:
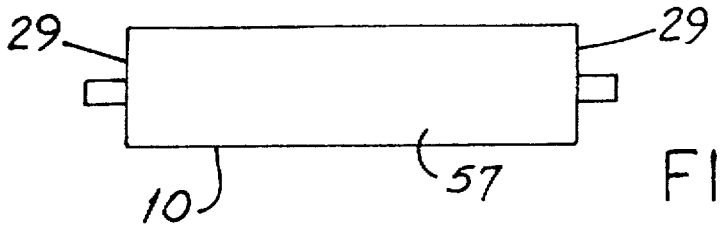
FIG. 15 is an elevation view of the new heated roller.

Referring to the FIGURES and particularly to FIGS. 15, 16A–16C which illustrate some of the temperature control features which are possible using the new heated roller 10. The vertical axes 107 represent temperature and the horizontal axes 109 represent points along the surface 57 of the roller 10. The curve 11 of FIG. 16A, 16B depicts the temperature along the surface 57 of the shell 11 when neither auxiliary coil 25 is energized. In the curve 112 of FIG. 16B, the auxiliary coils 25 are energized and the temperature closely adjacent to the ends 29 (such temperature being represented by the points 113) is very close to the temperature at point 114 about midway between such ends 29. FIG. 16C shows the temperature profile of the roller 10 when the left-end auxiliary coil 25 is energized or configured to provide a high rate of heat output. The temperature at the point 115, near the left end 29, is higher than the temperature at the point 116 midway between the ends 29. And the temperature at the point 117, near the right end 29, is lower than the temperature at the point 116.

While the principles of the invention have been disclosed in connection with a few preferred embodiments, it is to be understood clearly that such embodiments are by way of example and are not limiting.

What is claimed:

1. In a heated roller having an axis of rotation, a generally-cylindrical outer shell, a primary heating coil between the shell and the axis of rotation and radially spaced from the axis of rotation and a head at the end of the shell, the improvement wherein:

the head has an integral roller support shaft protruding therefrom, a cylindrical boss supporting the end of the shell and a helix groove around the boss;

an auxiliary heating coil is in the groove and is confined between the boss and the shell end, whereby the end of the roller may be temperature-controlled independently of the shell temperature.

2. The roller of claim 1 wherein:

the auxiliary coil has a pitch and a span length measured parallel to the axis of rotation and includes a plurality of turns of heating cable; and the pitch of the auxiliary coil is substantially uniform along the span length.

3. The roller of claim 2 wherein:

the cable has a cable length measured along its central axis; and the cable has a uniform wattage output per unit of cable length.

4. The roller of claim 3 wherein the cable is mineral insulated.

5. The roller of claim 2 wherein:

the cable includes a first cable portion having a first wattage output per unit of length of the first cable portion;

the cable includes a second cable portion having a second wattage output per unit of length of the second cable portion; and the second wattage output differs from the first wattage output.

6. The roller of claim 5 wherein the cable portions are mineral insulated.

7. The roller of claim 1 wherein:

the auxiliary coil has a pitch and a span length measured parallel to the axis of rotation and includes a plurality of turns of heating cable; and the pitch of the auxiliary coil varies along the span length.

8. The roller of claim 7 wherein:

the cable includes a first cable portion having a first wattage output per unit of length of the first cable portion;

the cable includes a second cable portion having a second wattage output per unit of length of the second cable portion; and the second wattage output per unit length differs from the first wattage output per unit length.

9. The roller of claim 7 wherein the cable is mineral insulated.

10. The roller of claim 1 wherein the shell has an exposed outer surface, the shell and the head are mounted for rotation about the axis of rotation and the roller includes at least one temperature sensor axially oriented in the shell for rotation therewith.

11. In a heated roller having an axis of rotation, a generally-cylindrical outer shell, a primary heating coil between the shell and the axis of rotation and radially spaced from the axis of rotation and a head at the end of the shell, the improvement wherein:

the head has an integral roller support shaft protruding therefrom, a cylindrical boss supporting the end of the shell;

the boss includes a face generally perpendicular to the axis of rotation;

a spiral groove is formed in the faces;

a spiral auxiliary heating coil is in the groove and is confined between the boss and the shell end, whereby the end of the roller may be temperature-controlled independently of the shell temperature.

12. The roller of claim 11 wherein the shell has an exposed outer surface, the shell and the head are mounted for rotation about the axis of rotation and the roller includes at least one temperature sensor axially oriented in the shell for rotation therewith.

13. In a heated roller having (a) spaced-apart roller ends, (b) first and second closure heads, each mounted at a respective one of the roller ends, (c) an axis of rotation, (d) a generally-cylindrical outer shell and (e) a heating coil lodged in a groove between the shell and the axis of rotation, the improvement wherein:

the coil is a helix coil spaced from and wound around the axis of rotation, has a pitch and a span length measured parallel to the axis of rotation and includes a plurality of turns of heating cable;

each successive turn of the said plurality of turns is closer to the second head and farther from the first head;

the pitch of the coil is substantially uniform along the span length;

the cable includes a first cable portion having a first wattage output per unit of length of the first cable portion;

the cable includes a second cable portion having a second wattage output per unit of length of the second cable portion;

the second wattage output per unit length is lower than the first wattage output per unit length;

the first cable portion is between the end and the second cable portion.

14. The roller of claim 13 including a rigid core extending along the axis of rotation and wherein:

the core extends from the axis of rotation radially outwardly and contacts the shell; and the groove is formed in the core.

15. In a heated roller having an axis of rotation, a generally-cylindrical outer shell, a primary heating coil between the shell and the axis of rotation and a head at the end of the shell, the improvement wherein:

the head includes an auxiliary heating coil having a pitch and a span length measured parallel to the axis of rotation and includes a plurality of turns of heating cable;

the pitch of the auxiliary coil is substantially uniform along the span length;

the cable includes a first cable portion having a first wattage output per unit of length of the first cable portion;

the cable includes a second cable portion having a second wattage output per unit of length of the second cable portion; and the second wattage output differs from the first wattage output.

16. The roller of claim 15 wherein the cable portions are mineral insulated.

17. In a heated roller having an axis of rotation, a generally-cylindrical outer shell, a primary heating coil between the shell and the axis of rotation and a head at the end of the shell, the improvement wherein:

the head includes an auxiliary heating coil having a pitch and a span length measured parallel to the axis of rotation and includes a plurality of turns of heating cable;

the pitch of the auxiliary coil varies along the span length;

the cable includes a first cable portion having a first wattage output per unit of length of the first cable portion;

the cable includes a second cable portion having a second wattage output per unit of length of the second cable portion; and the second wattage output differs from the first wattage output.

* * * * *

UNITED STATES PATENT AND TRADEMARK OFFICE

CERTIFICATE OF CORRECTION

PATENT NO. : 5,760,375

DATED : June 2, 1998

INVENTOR(S) : Timothy J. Hall

It is certified that error appears in the above-identified patent and that said Letters Patent is hereby corrected as shown below:

In column 4, line 48, delete "spirally" and insert --helix--.

In column 8, line 29, delete "faces" and insert --face--.

Signed and Sealed this

Twenty-fifth Day of August, 1998

Bruce Lehman

*Attest:*

BRUCE LEHMAN

*Attesting Officer*

*Commissioner of Patents and Trademarks*